US009222238B2

(12) United States Patent
Wezemer

(10) Patent No.: US 9,222,238 B2
(45) Date of Patent: Dec. 29, 2015

(54) DRAG HEAD AND TRAILING SUCTION HOPPER DREDGER

(75) Inventor: Serge Wezemer, Berkel en Rodenrijs (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 14/131,500

(22) PCT Filed: Jul. 4, 2012

(86) PCT No.: PCT/NL2012/050474

§ 371 (c)(1),
(2), (4) Date: Mar. 14, 2014

(87) PCT Pub. No.: WO2013/009172

PCT Pub. Date: Jan. 17, 2013

(65) Prior Publication Data

US 2014/0190044 A1 Jul. 10, 2014

(30) Foreign Application Priority Data

Jul. 8, 2011 (NL) ..... 2007072

(51) Int. Cl.
*E02F 3/92* (2006.01)
*E02F 3/88* (2006.01)
*E02F 5/00* (2006.01)

(52) U.S. Cl.
CPC ..... *E02F 3/9243* (2013.01); *E02F 3/8875* (2013.01); *E02F 3/9206* (2013.01); *E02F 3/9262* (2013.01); *E02F 3/9293* (2013.01); *E02F 5/006* (2013.01)

(58) Field of Classification Search
CPC ..... E02F 3/8875; E02F 3/9243; E02F 3/925; E02F 3/9256; E02F 3/9262; E02F 3/9206; E02F 3/9293; E02F 5/006
USPC ..... 37/307, 317, 321, 322, 323, 333
See application file for complete search history.

(56) References Cited

U.S. PATENT DOCUMENTS 4,265,035 A 5/1981 Goedvolk
4,628,623 A 12/1986 Deal (Continued)

FOREIGN PATENT DOCUMENTS

AU 2005 200 784 A1 9/2005
CN 1766240 5/2006

(Continued)

OTHER PUBLICATIONS

International Search Report, dated Sep. 14, 2012, from corresponding PCT application.

(Continued)

*Primary Examiner* — Jamie L McGowan
(74) *Attorney, Agent, or Firm* — Young & Thompson

(57) ABSTRACT

A drag head (100) for dredging material (2) from the bed (3) of a body of water and transporting the material (2) to a suction tube (120). The drag head (100) is arranged to be dragged over the bed (3) in a dragging direction (D). The drag head (100) includes a suction section (110) in which an under pressure can be created to suck up the material (2) from the bed (3) through a suction opening (113) into a suction chamber (112). A heel section (111) guides the drag head (100) along the bed (3). The suction section (110) is preferably rotatably connected to the heel section (111). The suction section (110) also includes an outlet (114) for transporting the material (2) towards the suction tube (120).

19 Claims, 4 Drawing Sheets

(56) References Cited

U.S. PATENT DOCUMENTS

| | | | | |
|---|---|---|---|---|
| 4,957,622 | A | 9/1990 | Mims | |
| 5,546,682 | A | 8/1996 | Skerry | |
| 5,732,487 | A * | 3/1998 | Van De Kerckhove | 37/333 |
| 8,286,375 | B2 * | 10/2012 | Tack | 37/318 |

FOREIGN PATENT DOCUMENTS

| | | | | |
|---|---|---|---|---|
| DE | 214463 | C | 12/1906 | |
| EP | 0 722 084 | A1 | 7/1996 | |
| EP | 0 735 203 | A1 | 10/1996 | |
| EP | 1 108 819 | A1 | 6/2001 | |
| EP | 1 653 009 | A1 | 5/2006 | |
| EP | 1653009 | A1 * | 5/2006 | E02F 3/9262 |
| GB | 2 096 672 | A | 10/1982 | |
| SU | 1 573 101 | A1 | 6/1990 | |

OTHER PUBLICATIONS

Chinese Office Action, dated Mar. 30, 2015, in corresponding Chinese Patent Application No. 201280043985.5.

* cited by examiner

DRAG HEAD AND TRAILING SUCTION HOPPER DREDGER

TECHNICAL FIELD

The invention relates to a drag head for dredging purposes and to a trailing suction hopper dredger comprising such a head. The invention further relates to methods of dredging.

BACKGROUND

Dredging at sea or in open water may be carried out by dredging vessels, such as a trailing suction hopper dredger (TSHD). The dredging vessels comprise a suction tube one end of which can be lowered to the seabed and used to suck up solids such as sand, sludge or sediment, mixed with water. This lower end of the suction tube can be provided with a suction head. The solid material mixed with water is pumped through the suction tube into a hopper of the dredging vessel.

Once the hopper is full, the pumping may continue causing an overflow. The overflow will mainly be formed by water, as the solids tend to sink to the bottom of the hopper. The pumping may be stopped when it is no longer efficient to continue, as may be the case when the overflow is becoming too dense.

The higher the density of the mixture of solids and water that is pumped through the suction tube, the more efficient the dredging is performed. Dredging with relatively high densities has many advantages. In the first place, dredging can be performed in a more time and cost efficient way. Secondly, more solid material can be pumped into the hopper. Also, overflow losses will be reduced or will even disappear which is advantageous from an energetic point of view. Furthermore, reducing overflow losses will reduce turbidity.

One element of the dredging installation that may limit the maximum density is the trailing suction head provided at the lower end of the suction tube.

DE214643C discloses a suction tube and a trailing suction head. The suction tube has a bend near the trailing suction head such that the suction opening faces the direction of motion. In the suction opening an adjustable sled member is provided to control the dredging depth. Also, an adjustable plate member may be provided in the suction opening to control the amount of water entering the suction opening. A dragging force is applied directly to the suction head by the suction tube.

Other trailing suction heads are known which comprise a body which is arranged to be dragged along the seabed. The body comprises connection means for connecting to a suction tube which may also serve to impart the drag force on the body. A visor having a cutting edge is hingeably connected at a rear side of the body. The angle of orientation and/or the depth of the cutting edge of the visor can be adjusted with respect to the body by means of hydraulic piston/cylinder devices. Jet nozzles are provided in the body to facilitate the dredging process by breaking up the material of the sea bed and fluidizing it for removal via the suction tube. In order to lift the dredged material from the cutting edge towards the inlet to the suction tube, a significant amount of mixing with water is required leading to a reduction in density of the mixture. At present for sand and silt dredging, mixture densities of on average 1350 kg/m$^3$ are achievable. A drag head of this type is known from EP1653009A1. Similar drag heads are known from EP1108819A1 and AU2005200784A1, the contents of each of which are herein incorporated by reference in their entirety.

It would be desirable to provide an alternative to the above discussed drag heads, in particular one which is capable of sucking up mixtures of water and material with a relatively high density in a relatively efficient way whereby excess water transport is minimised.

SUMMARY

According to the invention, there is provided a drag head for dredging material from a bed of a body of water and transporting the material to a suction tube, the drag head being arranged to be dragged over the bed in a dragging direction by a drag member, wherein the drag head comprises a heel section being connectable to the drag member and having a bed engaging surface arranged to follow the bed and a suction section comprising a suction opening; a suction chamber; and an outlet for connection to the suction tube such that an underpressure can be created in the suction chamber to suck up the material from the bed through the suction opening into the suction chamber, wherein the suction section is adjustably mounted to the heel section such that an orientation of the suction opening can be adjusted relative to the heel section. By providing the suction section separately adjustable from the heel section, the orientation of the suction opening can be set independently of the position of the heel which is being towed along the bottom of the seabed. Such an arrangement is believed to be considerably more versatile in optimizing the direction and/or height of the suction opening. Since the outlet also forms part of the suction section, its orientation may also be adjusted together with the suction opening. In the present context, reference to material is intended to refer to solid or semi solid material including silt, sand, sediment, mud, gravel and fractured rock as may generally be encountered during suction dredging operations. Furthermore, although reference may be made to sea bed, this is equally intended to cover and include beds of rivers, lakes, canals, estuaries and the like.

According to the invention the heel section is arranged to be connected to a drag member. The drag member may be a dragging pole, bar, pipe, cable, chain or the like or the suction tube itself, which is connected with the vessel to drag the drag head over the seabed. In the present context, reference to the fact that the heel section is connected to the drag member is understood to mean direct or indirect connection therewith. The dragging force is subsequently applied to the suction section via the heel section. Preferably, the suction section is not connected to the drag member except via the heel section.

The suction section may be adjustable in various ways using appropriate mechanical means as will be known to the skilled person. According to a preferred embodiment of the invention, the suction section is rotatable with respect to the heel section about an axis of rotation which is in use substantially horizontal and perpendicular to the dragging direction. Most preferably, this axis lies generally behind the heel section and ahead of the suction section with respect to the direction of movement of the drag head. Preferably too, the axis is positioned relatively low with respect to the bed engaging surface in order to maximize the mass of the suction section that acts downwards.

According to a further aspect of the invention, the suction section may comprise a lower edge, e.g. a cutting edge, forming a trailing edge of the suction opening, wherein the lower edge or cutting edge is in use lower than the bed engaging surface of the heel section in order to dig into the material forming the bed. The lower edge or cutting edge is preferably substantially horizontal and substantially perpendicular with respect to the dragging direction and points at least partially in the dragging direction. By providing the lower edge or cutting edge below the bed engaging surface of the heel section, the suction opening will be directed in the dragging direction. By rotating the suction section with respect to the heel section the relative depth of the lower edge or cutting edge with respect to the bed engaging surface of the heel section can be adjusted and thereby the depth of channel dredged by the drag head.

The cutting edge may comprise a row of cutting members, which may be formed as (replaceable) teeth being placed in corresponding teeth holders. In general, the width of the cutting edge transverse to the dragging direction may be any appropriate width according to the operation being performed. Nevertheless, in general, the width of the cutting edge will not be more than the width of the bed engaging surface of the heel section. In a most preferred embodiment, both of these sections may have similar widths. It will also be understood that although in general the heel section will lie ahead of the suction section in the direction of movement, this position is not necessarily essential. The heel section may in certain configurations be located to one or both sides or around the suction section.

According to one embodiment of the invention, the width of the suction section decreases from the suction opening towards the outlet, most preferably in a gradual way. This smooth transition assists the transport of the dredged material towards the outlet and helps avoid significant energy losses. Preferably, the suction chamber may have a tapered or trumpet like shape to provide a smooth transition between the relatively large suction opening and the smaller outlet towards the suction tube. The term width is used here to indicate the dimension substantially perpendicular to the dragging direction and, in use, substantially horizontal. As an additional or alternative measure, the suction section may have a bottom plate which is at least partially inclined in an upward direction from the lower edge or cutting edge towards the outlet. The bottom plate ensures a smooth flow path for the material that is sucked up, thereby reducing the resistance. The bottom plate may be straight or curved.

According to an embodiment the suction section may be connected to the suction tube via a flexible connection. Providing a flexible connection has the advantage that the suction section can be moved with respect to the heel section and the suction tube. The suction tube may be provided on and move with the heel section or may be independent therefrom. The flexible connection may be provided by a flexible reinforced tube or concertina section. Alternatively it may be achieved by telescoping sections of rigid pipe. Preferably, the flexible section is of low-loss design in order to further reduce flow resistance to the dredged mixture, whereby transport of higher mixture densities may be achieved. In a further alternative, the suction tube itself may be flexible.

In one embodiment, the suction opening is at least partially bounded by the heel section. In such a configuration, the suction section and heel section may engage together to form the suction chamber. The engagement between the two sections should be sufficiently tight that suction losses and water inflow from between the two sections may be minimal. In a particularly preferred embodiment, the heel section and the suction section comprise two half shells that engage or telescope together to form the suction chamber. The heel section provides the bed engaging surface while the suction section carries the lower edge or cutting edge and forms the suction outlet.

The drag head may be provided with means to form a desired mixture density of the dredged material, optimized to achieve transport to the surface with minimal liquid content. The skilled person will be aware of various manners in which this may be achieved using swirl vanes, cutting blades and the like. According to a preferred embodiment the drag head may comprise a plurality of conduits having outlet openings or nozzles for delivering water jets into the suction chamber at or near the outlet. These nozzles may preferably be located on the suction section and most preferably around the outlet. Such water jets may be provided to fluidize the material to make transport of the material easier.

According to a further embodiment, the drag head may be provided with means for breaking up or loosening the material of the sea bed at or ahead of the lower edge or cutting edge. In this case too, the choice of measure provided will depend on the particular material being dredged and the skilled person will be aware of the alternatives that may be used. In a preferred embodiment, a plurality of conduits having outlet openings for forming water jets beneath the bed engaging surface of the heel may be provided. Not only do such jets make it easier to remove the material from the bottom but they may also assist in fluidizing it to the desired degree for further transport.

According to an embodiment the outlet from the suction chamber is at least partially directed in a direction opposite to the dragging direction. By orientating the outlet from the suction section in this way, the material is initially sucked in a direction at least partially opposite to the dragging direction. This may assist in providing a natural and undisturbed flow path for the material, allowing for an energy efficient suction operation.

According to a still further aspect of the invention, the drag head may be provided with an actuator arrangement for displacing the suction section with respect to the heel section. This actuator may be a hydraulic, pneumatic or mechanical actuator and can be automatically operated to set a desired orientation or depth of the suction section or the cutting edge.

In an alternative arrangement, the desired orientation may be achieved without actuator by using the natural mass of the suction section. This may be weighted or biased with respect to the heel section to achieve the desired orientation. In one embodiment, the position of the hinge may be adjustable to achieve the desired weighting. In this manner the depth of the lower edge or cutting edge may be adjusted depending e.g. on the dragging speed, seabed consistency and other related factors.

According to a further aspect of the invention, the heel section may be provided with a pump to provide suction to the suction chamber via the suction tube. Preferably the pump is a high performance submerged dredge pump for operating with high mixture densities such as a centrifugal pump. The pump may be carried directly on the heel section and may carry the suction tube. Alternatively, the pump and/or the suction tube may be provided at a remote position or may be mounted to the drag member.

Preferably the pump is located at a suitable distance above the seabed to avoid damage and for most purposes will be located at about half the water depth in order to most efficiently assist in transport of the mixture.

The invention also relates to a vessel, such as a trailing suction hopper dredger, comprising a drag head as generally described above. In its working configuration, the heel section is attached to a drag member trailing from the vessel whereby the drag head may be dragged or towed along the seabed.

The invention further relates to a method of suction dredging a mixture of solids and water from the bed of a body of water using a drag head comprising a heel section and a suction section, the method comprising dragging the heel section across the bed in a first direction, positioning the suction section at a desired depth and angle with respect to the heel section such that the suction section at least partially engages and enters the bed, applying suction to the suction section to cause the bed material to be sucked up in a direction at least partially opposed to the first direction and be mixed with water and transporting the mixture to the surface.

Most preferably, the method is carried out for a mixture comprising sand and water having a density of more than 1650 kg/m$^3$. As a result of the desirable drag head configuration, such densities may be efficiently dredged.

BRIEF DESCRIPTION OF THE DRAWINGS

Embodiments will now be described, by way of example only, with reference to the accompanying schematic drawings in which corresponding reference symbols indicate corresponding parts, and in which.

The figures are meant for illustrative purposes only, and shall not serve as restriction of the scope or the protection as laid down by the claims.

DETAILED DESCRIPTION

Figure 1:
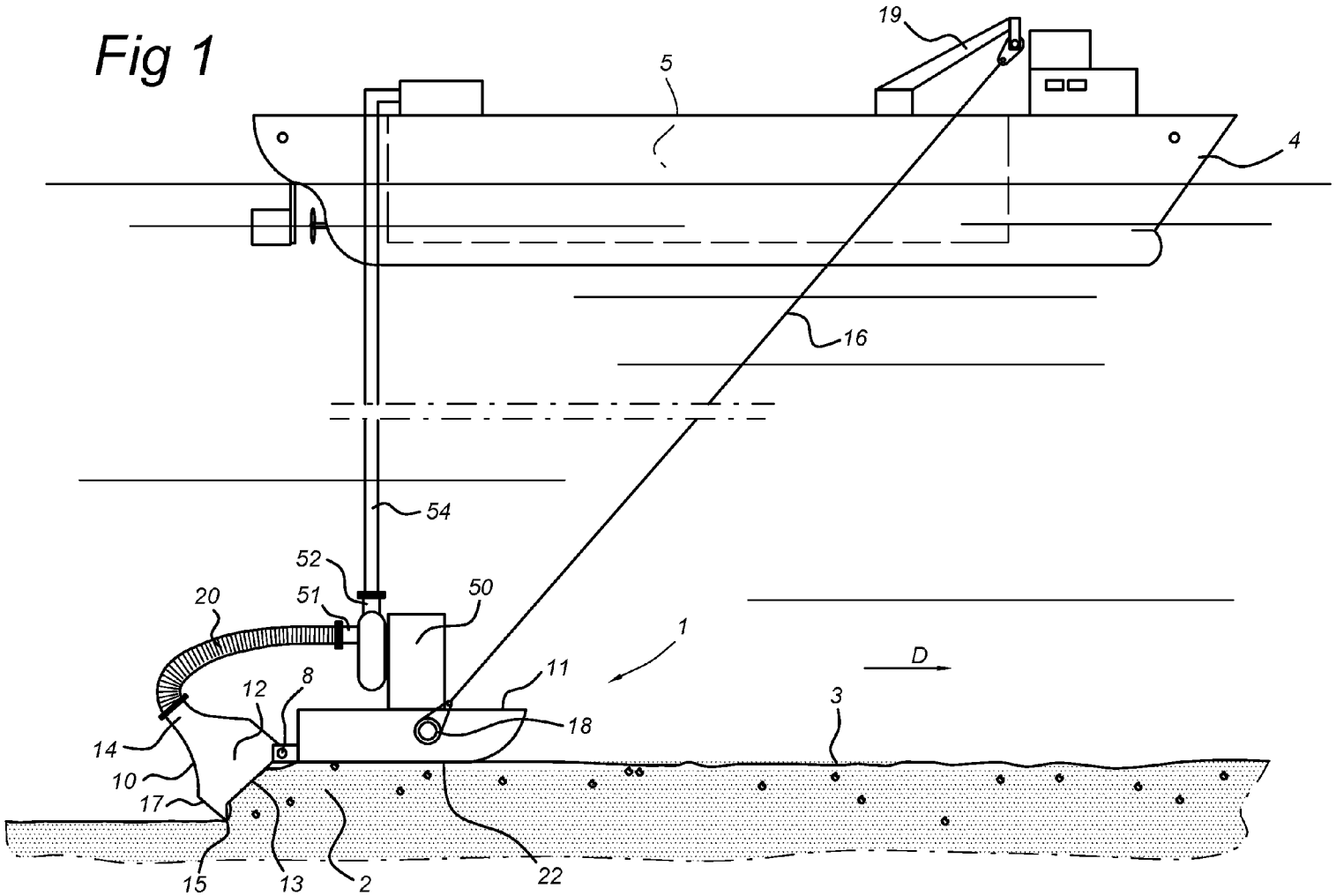
FIG. 1 schematically shows a side view of a first embodiment of the invention.

With reference to the figures, embodiments will now be described in more detail. According to FIG. 1, there is shown a schematic side view of a drag head 1 according to a first embodiment of the invention being used to dredge sand 2 or other similar material from the seabed 3 and transport it to a vessel 4.

Drag head 1 comprises a heel section 11 in the form of a sled and a suction section 10 having the form of a bucket, articulated together at a generally horizontal hinge 8. The heel section 11 is attached to a cable 16 via a pair of mounts 18 of which only one is shown. The cable 16 extends to the vessel 4 where it is held fast by a suitable derrick or boom 19 as is conventional in the art.

The heel section 11 has a bed engaging surface 22 on its underside. The bed engaging surface 22 is sufficiently long to ensure that the heel section assumes a substantially stable towing position. On its upper surface, heel section 11 carries a suction pump 50 which has a pump outlet 52 connected to a transport tube 54 leading to the surface and into a hopper 5 onboard the vessel 4.

The suction section 10 has a suction chamber 12 within its interior with a suction opening 13 at its lower side. A trailing edge or lower edge of the suction opening 13 forms a cutting edge 15. The cutting edge 15 may be provided with serrations (not shown). From the cutting edge 15 a bottom plate 17 leads up to an outlet 14 provided at an upper, rear side of the suction section 10. The outlet 14 connects the interior of the suction chamber 12 to a flexible suction tube 20. The suction tube 20 is connected to a pump inlet 51 on pump 50.

In use, the drag head 1 is dragged along the seabed 3 by the cable 16 in a direction of motion D. The heel section 11 follows the seabed 3 and the blades 24 on the bed engaging surface 22 cut into the sand 2 and loosen it. The suction section 10 pivots about the hinge 8 due to its mass and causes the cutting edge 15 to dig into the sea bed 3. The loosened sand 2 is scooped up by the cutting edge and rides up the bottom plate 17 towards the outlet 14. The pump 50 is operated to generate suction in the suction tube 20 causing water to also be sucked up through the suction opening 113. As the water and cut sand 2 approach the outlet 14, the narrowing of the suction chamber 13 causes their velocity to increase whereby the sand 2 becomes entrained with the water. The resulting mixture is pumped via the pump 50 and transport tube 54 to the surface and into the hopper 5. Due to the advantageous orientation of the suction opening 13 and the upward slope of the bottom plate 17 towards the outlet 14, the cut sand can be carried away with relatively little entrainment of water and a relatively high density of the mixture.

Figure 2:
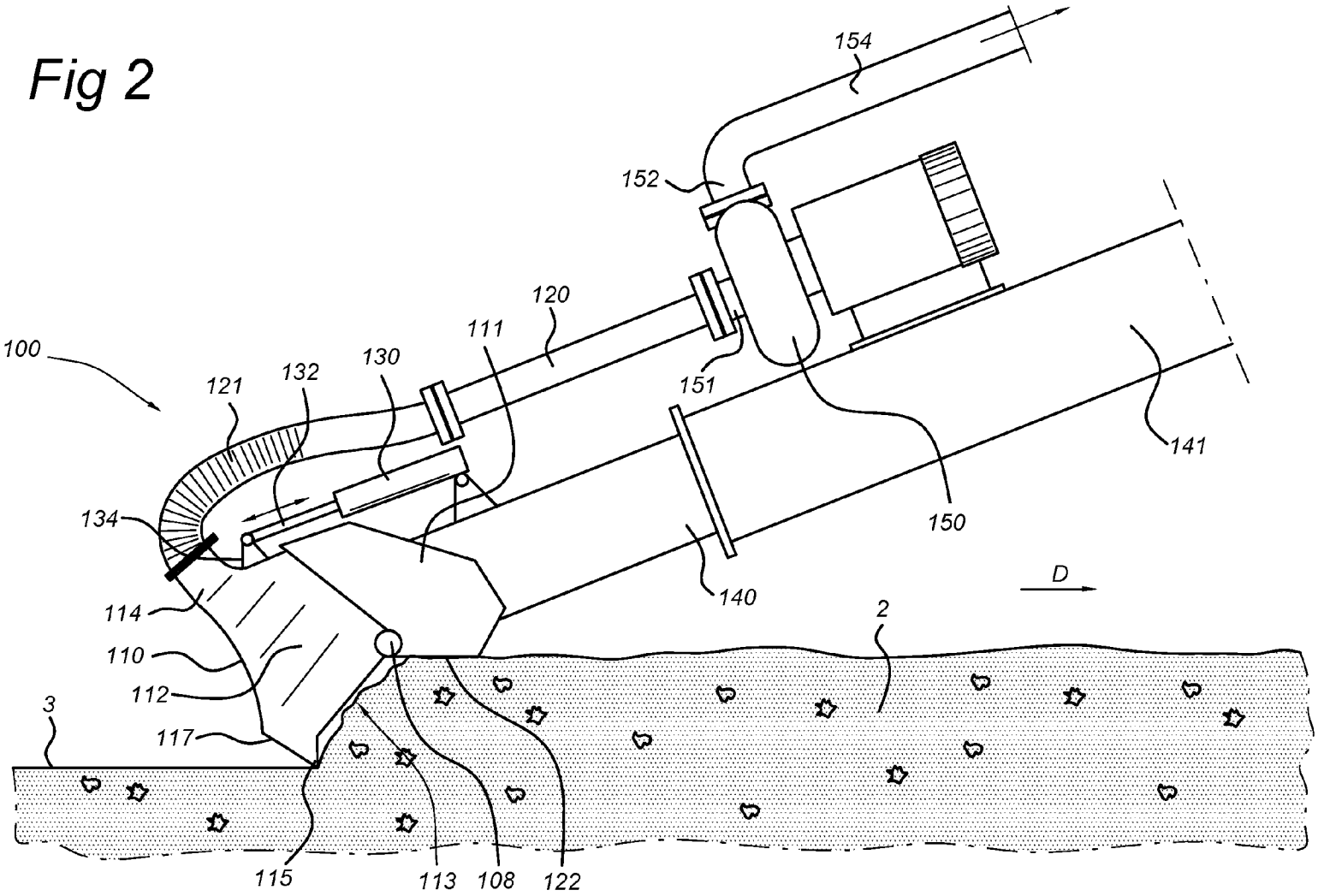
FIG. 2 schematically shows a side view of a second embodiment of the invention.

A second embodiment of a drag head 100 according to the invention is shown in FIG. 2 in which like elements are provided with similar reference numerals preceded by 100. FIG. 2 shows a heel section 111 and a suction section 110 which are hinged together at a hinge 108 forming a suction chamber 112 therebetween. The suction section 110 is slightly narrower than the heel section 111, whereby both sections can partially telescope into each other by rotation about the hinge 108. A lowermost or trailing edge of the suction section 110 is provided with a cutting edge 115. The heel section 111 has a lowermost bed engaging surface 122. Between the cutting edge 115 and the rear edge of the bed engaging surface 122 there is formed a suction opening 113 providing access to the suction chamber 112.

In the embodiment of FIG. 2, the heel section 111 further comprises a tubular body 140 rigidly attached to a front surface thereof. The tubular body 140 is in turn connected to a drag member 141 which is towed from the vessel 4 as in FIG. 1. The drag member 141 and the tubular body 140 form a relatively rigid arm extending to the surface (although it will be understood that powered joints may be foreseen) which ensures that the angle of the heel section 111 with respect to the seabed remains substantially constant (for a given depth of water).

On an upper surface of the tubular body 140 there are provided a pair of actuators 130 (of which one is shown in this view) having piston arms 132 attached to an upper portion of the suction section 110 at a mount 134. By operating the actuators 130, the suction section 110 can be pivoted with respect to the heel section 111 to cause the cutting edge 115 to dig deeper into the sea bed.

As in the first embodiment, the suction section has a bottom plate 117 which leads upwards to an outlet 114 at an upper rear part of the suction section. Unlike the first embodiment, the outlet 114 is connected to a flexible connection 121 which in turn connects to the suction tube 120. In this case, the pump 150 is carried by the drag member 141 and has a pump inlet 151 connected to the suction tube 120 and a pump outlet 152 connected to transport tube 154.

Figure 3:
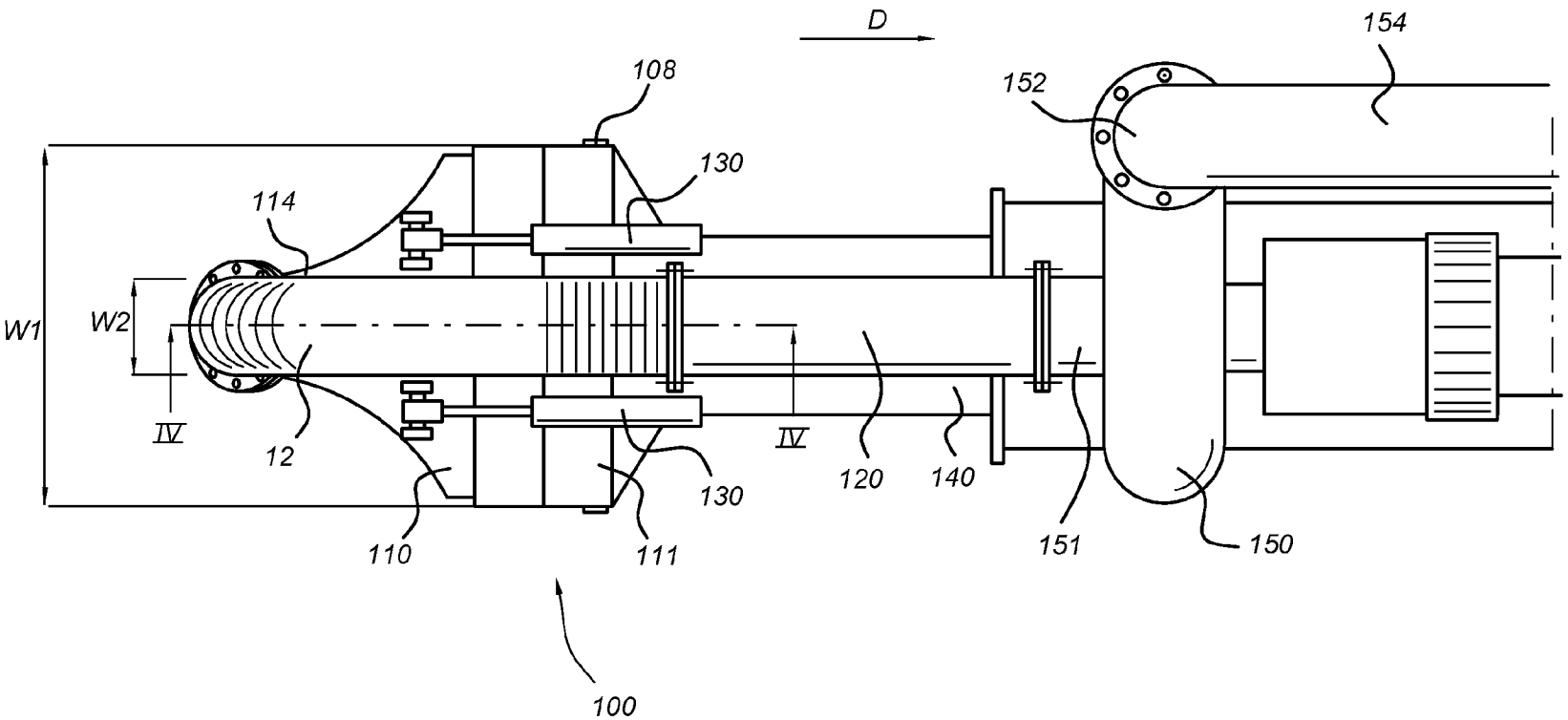
FIG. 3 schematically shows a top view of the embodiment of FIG. 2.

FIG. 3 shows a plan view of the embodiment of FIG. 2 showing heel section 111 and suction section 110 engaging each other with actuators 130 determining the degree of rotation of the sections about hinge 108. According to FIG. 3, it can be seen that the heel section 111 and the suction section 110 have a maximum width W1 at the position of the cutting edge. From this position, the width of the suction section 110 decreases to a width W2 at the outlet 114.

Figure 4:
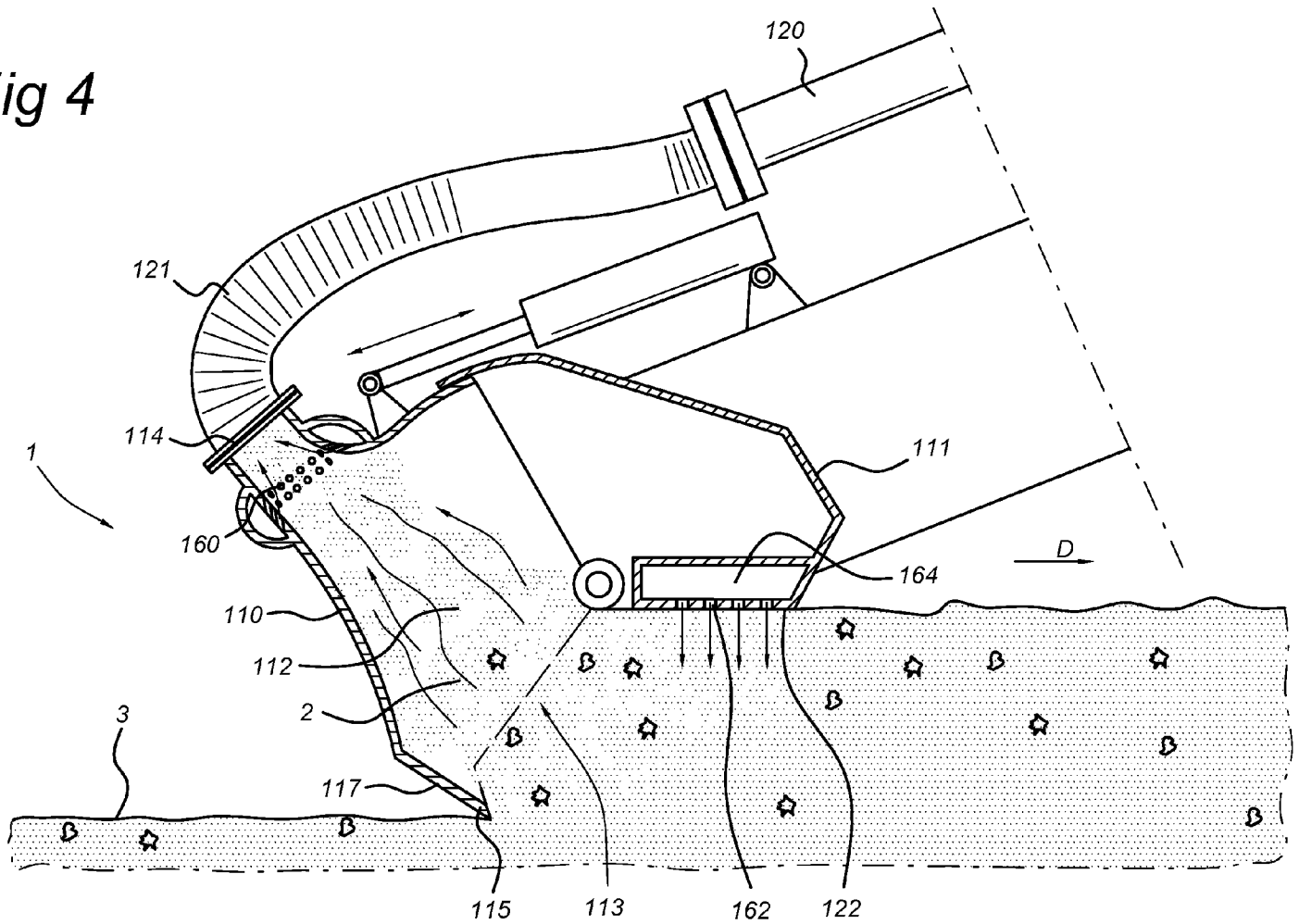
FIG. 4 schematically shows a cross-sectional view taken at line 4-4 in FIG. 3.

FIG. 4 is a sectional view taken on line 4-4 in FIG. 3 showing an interior of the suction chamber 112. In this view, nozzles 160 can be seen located around outlet 114. The nozzles 160 are connected to a suitable source of pressure (not shown) and are operated to generate pressurized jets of water within the outlet 114 directed towards the flexible connection 121. Also visible in FIG. 4 are further nozzles 162 provided in the bed engaging surface 122 of the heel section 111. The further nozzles 162 are in communication with a pressure manifold 164 within the heel section 111 into which pressurized water may be supplied from the source of pressure mentioned above.

In use, the drag head 100 is dragged along by the dredging vessel in the direction D with the heel section 111 engaging the seabed 3. Pressurised water is provided to the manifold 164 which causes the formation of jets of water from further nozzles 162 beneath the bed engaging surface 122. The jets of water loosen and partially break up the sand or silt 2. The loosened sand 2 is cut and lifted by cutting edge 115 and enters suction chamber 112 through suction opening 113. The reducing width of the suction chamber 112 and the bottom plate 117 funnel the sand 2 upwards towards the outlet 114. At this stage, the sand contains a quantity of entrained water due to the further nozzles 162. Nevertheless, the density is too high for it to be easily transported. As the sand and water mixture enters the outlet 114 additional water jets are injected through nozzles 160. These jets further loosen the sand 2 and fluidise it to a desired final density of around 1650 kg/m$^3$ for transport via the pump 150 and transport tube 154 to the surface. Due to the increased density, the vessel 4 can be filled without overflow or further discharge back into the water which is highly advantageous for sensitive environments where such discharge during dredging is prohibited.

Thus, the invention has been described by reference to certain embodiments discussed above. It will be recognized that these embodiments are susceptible to various modifications and alternative forms well known to those of skill in the art. In particular, the arrangement of flexible connection of FIG. 2 may be replaced by a telescoping arrangement. Furthermore, the actual design may be distinct from the schematically illustrated designs.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A drag head for dredging material from a bed of a body of water and transporting the material to a suction tube, the drag head comprising:

a heel section connectable to a drag member such that the heel section and the drag member are fixed relative to each other, the heel section having a bed engaging surface configured to follow the bed so that the drag head is configured to be dragged over the bed in a dragging direction by a drag member; and a suction section comprising:

a suction opening, a suction chamber, an outlet for connection to the suction tube such that an underpressure can be created in the suction chamber to suck up the material from the bed through the suction opening and the suction chamber to the outlet, and a lower edge forming a trailing edge of the suction opening and the last point of contact between the drag head and the bed, the lower edge being lower than the bed engaging surface of the heel section, the suction section being adjustably mounted to the heel section at a hinge point such that the entire suction section is configured to rotate relative to the heel section and the drag member so that an orientation of the suction opening is adjusted relative to the heel section and the drag member, and such that a dragging force from the drag member is applied to the heel section, the dragging force then being applied to the suction section via the heel section.

2. The drag head according to claim 1, wherein the suction section is rotatable with respect to the heel section about an axis of rotation which is, in use, substantially horizontal and perpendicular to the dragging direction.

3. The drag head according to claim 2, wherein the axis lies behind the heel section and ahead of the suction section with respect to the direction of movement of the drag head.

4. The drag head according to claim 1, wherein the suction section comprises a cutting edge forming a trailing edge of the suction opening, the cutting edge being, in use, lower than the bed engaging surface of the heel section.

5. The drag head according to claim 4, wherein a width of the bed engaging surface of the heel section corresponds substantially to a width of the cutting edge.

6. The drag head according to claim 4, wherein the suction section has a bottom plate which is at least partially inclined in an upward direction from the cutting edge to the outlet so that the cutting edge is the last contact between the drag head and the bed.

7. The drag head according to claim 1, further comprising a flexible connection between the outlet and the suction tube to enable rotational movements of the suction section and the lower edge with respect to the heel section and the suction tube.

8. The drag head according to claim 1, wherein the suction opening is at least partially bounded by the heel section.

9. The drag head according to claim 1, wherein the suction section and heel section engage together to form the suction chamber.

10. The drag head according to claim 1, further comprising a plurality of conduits having outlet openings configured to form water jets in the suction chamber in or near the outlet and/or beneath the bed engaging surface of the heel section.

11. The drag head according to claim 1, wherein the outlet from the suction chamber is at least partially directed in a direction opposite the dragging direction.

12. The drag head according to claim 1, further comprising an actuator arrangement configured to displace the suction section with respect to the heel section.

13. The drag head according to claim 1, wherein the suction section is weighted or biased with respect to the heel section to achieve a desired orientation.

14. The drag head according to claim 1, further comprising a suction pump mounted on or adjacent to the heel section.

15. A vessel, comprising:

a drag member; and a drag head according to claim 1, wherein the heel section is operatively connected to be dragged along the bed by the drag member.

16. The drag head according to claim 1, wherein the suction section is one integral piece.

17. A method of suction dredging a mixture of solids and water from a bed of a body of water using a drag head including a heel section and a suction section, the suction section including a suction opening, a suction chamber, an outlet for connection to the suction tube, and a lower edge forming a trailing edge of the suction opening, the lower edge being lower than the bed engaging surface of the heel section and being the last point of contact between the drag head and the bed, the suction section being adjustably mounted to the heel section, the method comprising:

dragging the heel section across the bed in a first direction, the suction section being adjustably mounted to the heel section such that a dragging force is first applied from the drag member to the heel section, and the dragging force is applied to the suction section only via the heel section;

positioning the suction section at a desired depth and angle with respect to the heel section such that the suction section at least partially engages and enters the bed;

applying suction to the suction section to cause the bed material to be sucked up in a direction at least partially opposed to the first direction and be mixed with water; and transporting the mixture to a surface of the body of water.

18. The method according to claim 17, further comprising injecting liquid into the mixture such that the mixture comprises sand and water having a density of more than 1650 kg/m3.

19. The vessel according to claim 15, wherein the vessel is a trailing suction hopper dredger.

* * * * *